US006789369B1

(12) United States Patent
Hughes

(10) Patent No.: US 6,789,369 B1
(45) Date of Patent: Sep. 14, 2004

(54) COMPOSITE WINDOW FRAME STRUCTURAL MEMBER

(75) Inventor: Steve D. Hughes, Dexter, IA (US)

(73) Assignee: Monarch Manufacturing Company, Adel, IA (US)

( * ) Notice: Subject to any disclaimer, the term of this patent is extended or adjusted under 35 U.S.C. 154(b) by 0 days.

(21) Appl. No.: 10/405,381

(22) Filed: Apr. 3, 2003

(51) Int. Cl.[7] ..... E04C 3/30
(52) U.S. Cl. ..... 52/730.1; 52/730.6
(58) Field of Search ..... 52/730.3, 730.6, 52/309.1, 730.1

(56) References Cited

U.S. PATENT DOCUMENTS 5,406,768 A * 4/1995 Giuseppe et al. ..... 52/730.4
6,530,185 B1 * 3/2003 Scott et al. ..... 52/215
2001/0034986 A1 * 11/2001 Thomas et al. ..... 52/211
2003/0019184 A1 * 1/2003 Habicht ..... 52/730.6

* cited by examiner

*Primary Examiner*—Ramon O Ramirez
(74) *Attorney, Agent, or Firm*—G. Brian Pingel; Camille L. Urban

(57) ABSTRACT

The composite window frame structural member provides an elongated structural member comprising a polymer and wood fiber composition suitable for use and the manufacture of a window frame to be embedded in a concrete wall to define an opening therein and includes a top surface defining one side of the opening and a bottom surface that has at least two longitudinally extending concrete engaging members formed with an outer end and an inner end arcuately undercut to permit an even flow of concrete about the tendons as the concrete wall is poured.

10 Claims, 2 Drawing Sheets

COMPOSITE WINDOW FRAME STRUCTURAL MEMBER

BACKGROUND OF THE INVENTION

1. Field of the Invention

The present invention relates to a frame member used for forming a window opening in a structural wall such as a poured concrete wall and serves as a frame member for a window.

2. Description of the Prior Art

Most homes in northern climates have basements that are formed from poured concrete. In constructing such basements, forms of various types are generally installed to define sidewalls and to guide concrete around various objects such as windows and door frames so that the concrete is formed in a desired building structure. It is a common practice in the industry to use wooden or steel frames for the windows, which frames are partially embedded in the concrete and are held thereby. Although such construction process provides a relatively simplistic method for providing a window frame in a concrete wall, the process suffers from serious deficiencies.

Firstly, embedded window frames in concrete walls are subject to deterioration during the passage of time or the frame may become dislodged from the concrete wall. In either event, the resulting condition is unsatisfactory and requires replacement of the frame, a task that is not easily completed.

The present invention is specifically adapted to overcome the deficiencies of prior art window frames and is formed from a composition and is of a specific design to significantly avoid the deleterious affects of deterioration and/or breakage from the concrete wall.

SUMMARY OF THE INVENTION

The present invention provides an elongated structural member comprising a polymer and wood fibre composition suitable for use and manufacture of a window frame to be embedded in a poured concrete wall to define an opening therein and includes a top surface defining one side of the opening and a bottom surface that includes concrete engaging means for securely fastening the member to the concrete wall once drying is completed.

The concrete engaging means includes at least two longitudinally extending tenons located on opposite sides of said bottom surface and are formed with an outer end and an inner end that is arcuately undercut to permit an even flow of concrete about the tenons as the concrete wall is poured. Additionally, the bottom surface may also include at least one medially located tenon formed with outer end and an inner end that is arcuately undercut to permit an even flow of concrete about said medial tenon as the concrete wall is formed.

In a preferred embodiment, the bottom surface includes a pair of medially located tenons, each formed with an outer end and an inner end that is arcuately undercut to permit an even flow of concrete thereabout. In such embodiment, each of said side tenons is associated with one of said medial tenons whereby said tenons each have a boss that extends towards the boss on the other tenon to form a concrete engaging tenon combination to form a reliable and efficient securement of the structural member in the concrete wall.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may employed in a variety of other embodiments and reference is made to the claims herein for interpreting the breadth of the invention.

DETAILED DESCRIPTION OF THE PREFERRED EMBODIMENT

Figure 1:
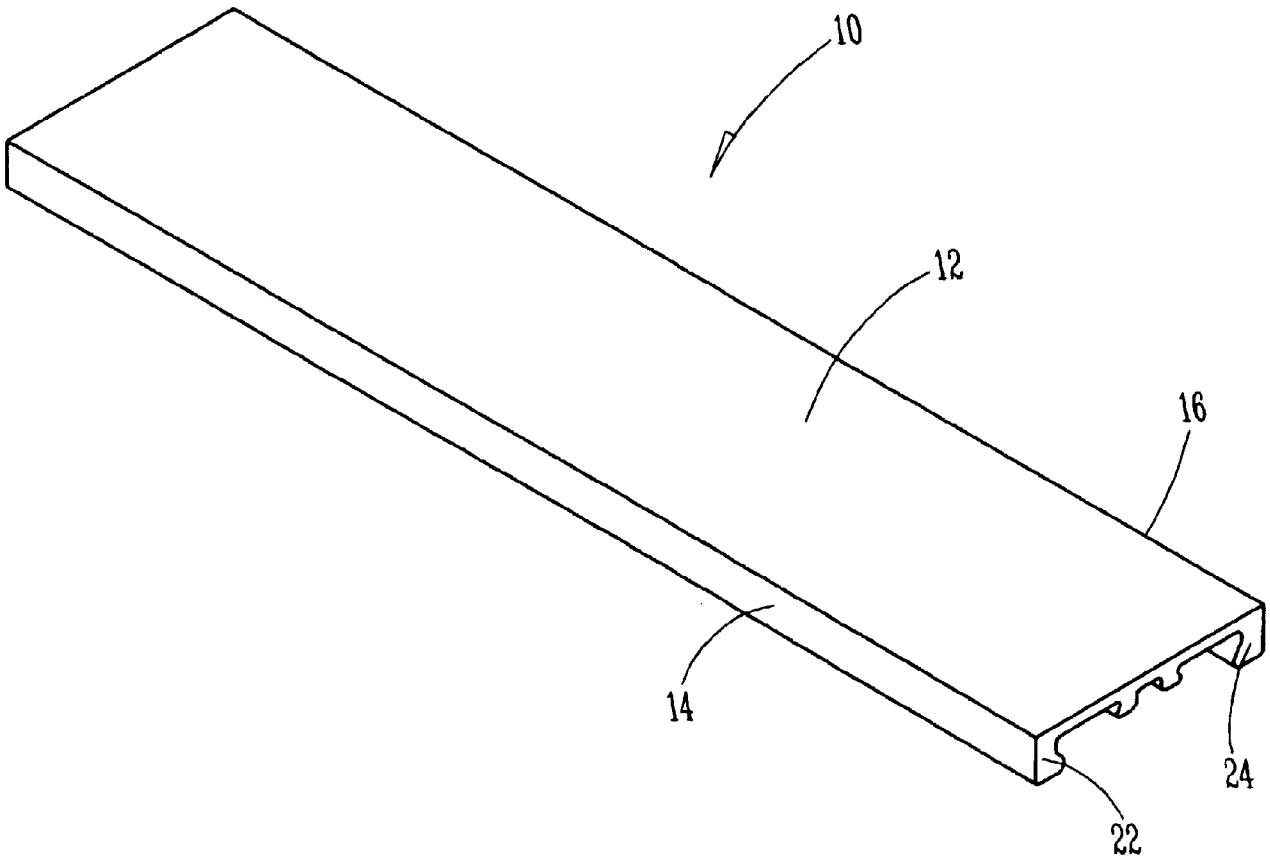
FIG. 1 is a top side perspective view of a preferred embodiment of the present invention.

Referring now to the drawings and with reference first to FIG. 1, a structural member of the present invention is shown generally at 10. As illustrated, the member 10 is elongated in shape and is composed of a combination of polymer and wood fibre in amounts approximately equal to one another for use in the manufacture of a window frame to be embedded in a concrete wall to define an opening therein. The use of a composite polymer-wood fibre composition is highly advantageous in the present invention to prevent deterioration of the structural member 10 over the passage of time. Also, by the use of such a composition, the member 10 can be formed in its unique shape that is disclosed herein to be effectively and efficiently secured in the concrete wall with which it is used as is will now be described.

The member 10 has a top surface 12 that is flat to define one side of a window frame. Obviously, those skilled in the art will fully recognize that the specific dimensions of the structural member 10 are highly variable and can be of a wide variety of sizes depending upon the size of the window opening desired.

Figure 2:
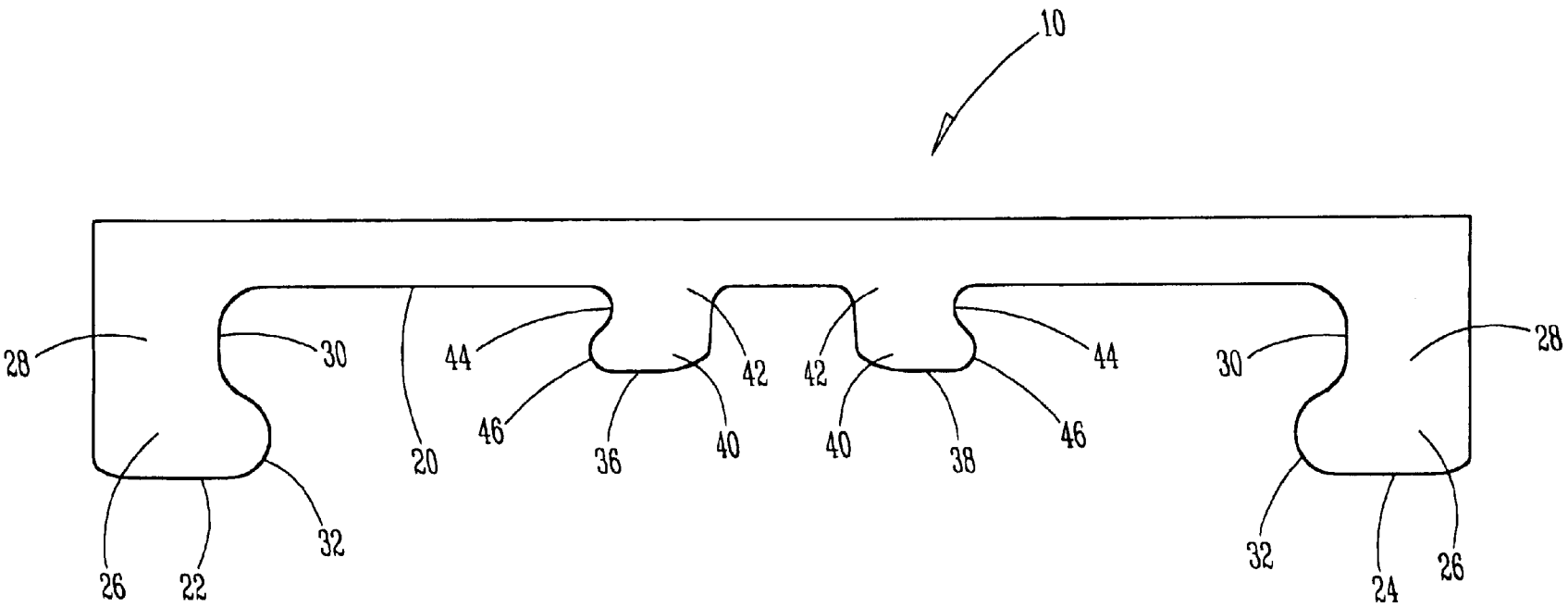
FIG. 2 is an end view in elevation of the embodiment of the FIG. 1.

Opposite side edges 14 and 16 define the sides of the member 10. However, to secure the member 10 in a poured concrete wall, the member 10 has a bottom 20 that is provided with a plurality of concrete engaging means, as best shown in FIG. 2. Preferably, the member 10 has concrete engaging means that comprise two longitudinally extending tenons 22 and 24 located on opposite sides of the bottom 20. Each of the tenons 22 and 24 are formed with an outer end 26 and an inner end 28. Each of the inner ends 28 has an arcuately shaped undercut 30 to permit an even flow of concrete about the tenons 22 and 24 as the concrete wall is poured.

As a result of the undercuts 30, each of the tenon outer ends 26 includes an arcuately shaped boss 32 extending in direction transverse to the bottom 20 and away from their respective sides 14 and 16 so as to extend toward one another. Due to the extension of the bosses 32 and the shape of the undercuts 30, the tenons 22 and 24 securely fasten the member 10 to a concrete wall structure in which they are embedded, and the arcuate shape of the tenons 22 and 24 permits the flow of concrete thereabout without the creation of voids or other disruptions.

To further enhance the securement of the member 10 to a concrete wall structure, the concrete engaging means may also include a pair of medially located tenons 36 and 38 to coact with the tenons 22 and 24. In shape, the tenons 36 and 38 are somewhat similarly shaped to that of the tenons 22 and 24 as each includes an outer end 40 and an inner end 42. The medial tenon inner ends 42 each have an arcuately shaped undercut 44 that essentially serves the same purposes as that of the undercuts 30. Similar to the tenons 22 and 24, the tenon outer ends 40 are formed with boses 46 that extend transversely of the member bottom 20 and in directions opposite to that of one another. Although the preferred embodiment includes a pair of medial tenons 36 and 38, it should be obvious to one skilled in the art that instead of using two such tenons, a single medially positioned tenon having opposing bosses 46 can also be utilized if desired.

As can be best seen from the illustration of FIG. 2, each of the side tenons 22 and 24 has a boss 32 that extends in the direction of its associated medial tenon 36 or 38. Conversely, each of the medial tenons 36 or 38 has a boss 46 that extends in the direction of its associated side tenons 22 or 24. Thus the tenons 22 and 36 and 24 and 38 form a tenon combination with the bosses of each extending toward one another. As a result, when the member 10 is secured in a poured wall of concrete, the combination of the side and medial tenons prevents movement of the member 10 in the concrete wall in a direction transverse to such wall.

Thus, the present invention provides a novel, efficient and simplistic means for providing a structural member that is suitable for use and manufacture of a window frame to be embedded in a concrete wall. Although the structural member 10 of the present invention has been described with respect to a preferred embodiment, it should be understood that such embodiment may be altered without avoiding the true spirit and scope of the present invention. It is also important to note that various modifications may be made to the disclosed embodiment.

What is claimed is:

1. An elongated structural member comprising a polymer and wood fibre composition suitable for use in the manufacture of a window frame to be embedded in a concrete wall to define an opening therein, said member further comprising:

(a) a top surface defining one side of said opening; and (b) a bottom surface for embedding in said concrete and having at least two longitudinally extending concrete engaging tenons located on opposite sides of said bottom surface and formed with an outer end and an inner end that is arcuately undercut in a side of each tenon to permit an even flow of concrete about said tenons as said concrete is poured.

2. A structural member as recited in claim 1, wherein said bottom surface further includes at least one medially located tenon formed with an outer end and an inner end that is arcuately undercut to permit an even flow of concrete about said media tenon as said concrete wall is formed.

3. A structural member as recited in claim 1, wherein said bottom surface includes at least two medially located tenons.

4. A structural member as recited in claim 3, wherein each of said medial tenons include an arcuately shaped boss formed on the outer end and extending transversely of said bottom surface.

5. A structural member as recited in claim 4, wherein said bosses on said medial tenons extend in opposite directions.

6. A structural member as recited in claim 1, wherein said side tenons have arcuately shaped bosses formed on their outer ends.

7. A structural member as recited in claim 6, wherein said bosses on said side tenons extend transversely to the bottom surface in directions opposite to one another.

8. A structural member as recited in claim 7, wherein said bottom surface further includes a pair of medially located tenons, each formed with an outer end and an inner end that is arcuately undercut to permit an even flow of concrete about said medial tenons as said concrete wall is formed.

9. A structural member as recited in claim 8, wherein said outer ends of said medial tenons are formed with bosses extending transversely to said bottom surface.

10. A structural member as recited in claim 9, wherein one of said side tenons is associated with one of said medial tenons whereby each of said tenons has a boss that extends toward the boss on said other tenon to form a concrete engaging tenon combination to secure said structural member in said concrete wall.

* * * * *